US008864253B2

(12) United States Patent
Görz et al.

(10) Patent No.: US 8,864,253 B2
(45) Date of Patent: Oct. 21, 2014

(54) REFRIGERATION DEVICE COMPRISING AN INSULATION STRIP FOR THERMALLY DECOUPLING THE LATERAL WALLS

(75) Inventors: Alexander Görz, Aalen (DE); Hans-Philipp Reitz, Giengen (DE)

(73) Assignee: BSH Bosch and Siemens Hausgerate GmbH, Munich (DE)

( * ) Notice: Subject to any disclaimer, the term of this patent is extended or adjusted under 35 U.S.C. 154(b) by 661 days.

(21) Appl. No.: 12/085,297

(22) PCT Filed: Oct. 18, 2006

(86) PCT No.: PCT/EP2006/067539

§ 371 (c)(1),
(2), (4) Date: May 20, 2008

(87) PCT Pub. No.: WO2007/062909

PCT Pub. Date: Jun. 7, 2007

(65) Prior Publication Data

US 2010/0219732 A1 Sep. 2, 2010

(30) Foreign Application Priority Data

Nov. 30, 2005 (DE) ..... 10 2005 057 143

(51) Int. Cl.
*A47B 88/00* (2006.01)
*F25D 23/06* (2006.01)
*F25D 23/08* (2006.01)

(52) U.S. Cl.
CPC ..... *F25D 23/085* (2013.01); *F25D 23/064* (2013.01)
USPC ..... 312/406

(58) Field of Classification Search
CPC ... F25D 23/066; F25D 23/082; F25D 23/085; F25D 23/087
USPC ..... 62/265; 220/592.02, 592.05–592.09, 220/592.1; 312/406, 406.1, 406.2, 405, 312/401, 116
See application file for complete search history.

(56) References Cited

U.S. PATENT DOCUMENTS 2,256,013 A 9/1941 Brouse
2,276,635 A 3/1942 Weber (Continued)

FOREIGN PATENT DOCUMENTS

FR 2.028.828 10/1970
GB 527231 10/1940

(Continued)

OTHER PUBLICATIONS

International Search Report PCT/EP2006/067539.

*Primary Examiner* — Hanh V Tran
(74) *Attorney, Agent, or Firm* — Nixon & Vanderhye P.C.

(57) ABSTRACT

A refrigeration device, in particular a refrigerator and/or freezer, includes a housing with a top, a base, lateral walls and a rear wall as external walls, a door, an interior compartment situated in the housing and surrounded by internal walls and a front frame for thermally decoupling the internal walls from the external walls, the lateral walls being thermally insulated from the other walls by an additional insulation strip. The invention is characterized in that the entry of heat from the exterior into the interior compartment via the lateral walls can be significantly reduced by the thermal decoupling of the lateral walls, thus significantly increasing the efficiency of the refrigeration device.

20 Claims, 13 Drawing Sheets

(56) References Cited

U.S. PATENT DOCUMENTS

| | | | | | |
|---|---|---|---|---|---|
| 2,582,862 | A | | 1/1952 | Frykdahl | |
| 2,625,291 | A | | 1/1953 | Moore | |
| 2,648,584 | A | | 8/1953 | Morton | |
| 2,675,687 | A | * | 4/1954 | Philipp | 62/275 |
| 2,809,764 | A | | 10/1957 | Diamond | |
| 2,997,353 | A | | 8/1961 | Horvay | |
| 3,164,869 | A | | 1/1965 | Barkan | |
| 3,520,581 | A | * | 7/1970 | Borghi | 312/406 |
| 3,588,214 | A | * | 6/1971 | Stimamiglio | 312/406 |
| 3,632,012 | A | | 1/1972 | Kitson | |
| 3,688,384 | A | * | 9/1972 | Mizushima et al. | 220/592.1 |
| 3,834,101 | A | * | 9/1974 | Wilder et al. | 52/309.11 |
| 4,099,812 | A | * | 7/1978 | Morphy | 312/406.2 |
| 4,953,362 | A | * | 9/1990 | Shoji et al. | 312/116 |
| 5,388,904 | A | * | 2/1995 | Kuwahara et al. | 312/406.2 |
| 5,890,785 | A | * | 4/1999 | Vismara | 312/406 |
| 5,908,229 | A | * | 6/1999 | Wetherholt et al. | 312/406.2 |
| 6,464,312 | B1 | * | 10/2002 | Tenhundfeld et al. | 312/405 |
| 6,485,122 | B2 | * | 11/2002 | Wolf et al. | 312/406.2 |
| 6,655,766 | B2 | * | 12/2003 | Hodges | 312/406.2 |
| 2002/0041134 | A1 | | 4/2002 | Wolf et al. | |
| 2002/0180322 | A1 | | 12/2002 | Liu et al. | |

FOREIGN PATENT DOCUMENTS

| | | | | | |
|---|---|---|---|---|---|
| GB | 802756 | | | 10/1958 | |
| GB | 808970 | | | 2/1959 | |
| JP | 49-6537 | | | 1/1974 | |
| JP | 59079720 | A | * | 5/1984 | 312/406.2 |
| WO | WO 01/16540 | | | 3/2001 | |

* cited by examiner

Fig. 4
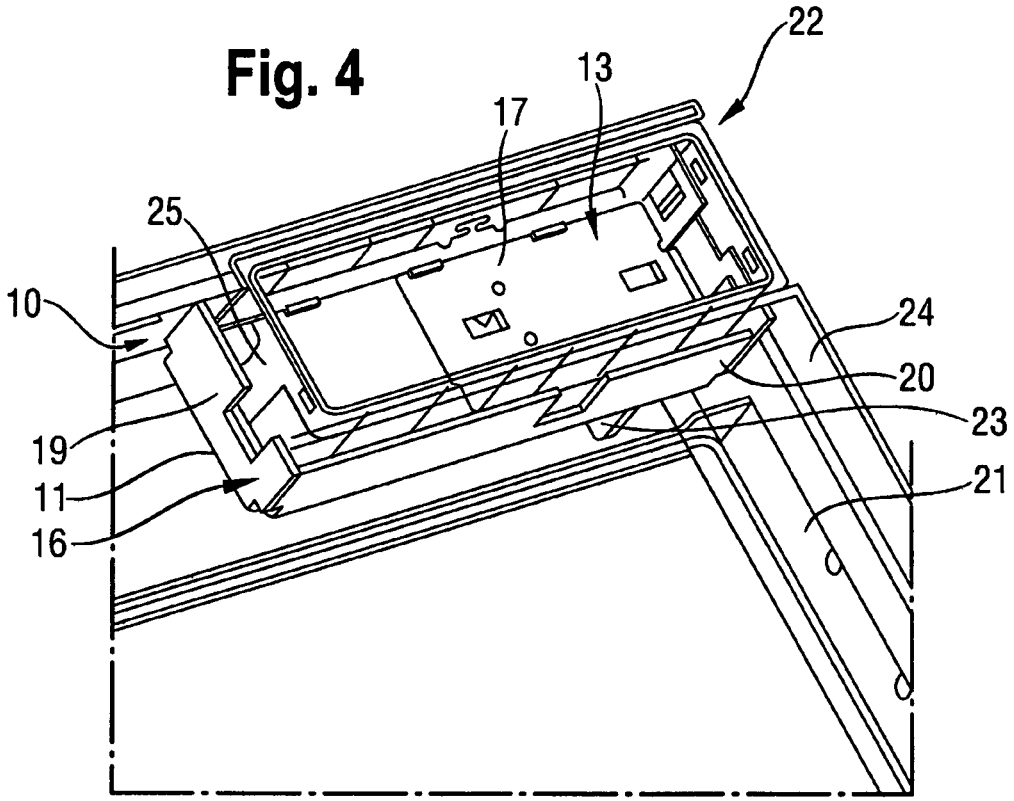
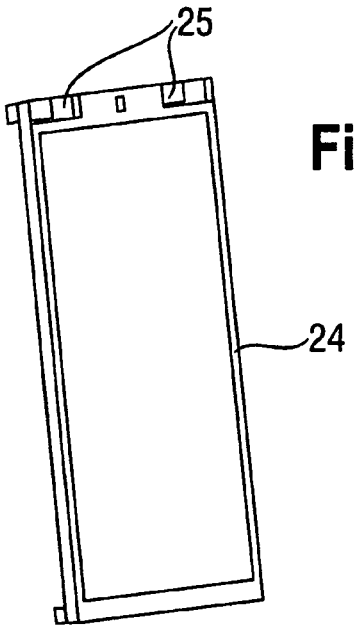
Fig. 5

REFRIGERATION DEVICE COMPRISING AN INSULATION STRIP FOR THERMALLY DECOUPLING THE LATERAL WALLS

BACKGROUND OF THE INVENTION

The invention relates to a refrigeration device, especially a refrigerator or freezer, comprising a housing with a top, a base, lateral walls and a rear wall as outer walls and a door, an inner chamber located in the housing which is surrounded by inner walls, and a front frame for thermally decoupling the inner walls from the outer walls.

Refrigeration devices are known with housing constructions in which between the metallic inner walls which surround an inner chamber located in the housing, and the metallic outer walls of the housing a plastic front frame is used in order to avoid a direct heat bridge between the inner and outer walls.

The problem of heat transmission arises especially if the inner walls and the outer walls are made from metal, which has a high thermal conductivity. The plastic front frame serves to worsen the direct heat transfer between the inner walls and the outer walls. As a rule the housing is filled between the inner and outer walls with an insulating foam which reduces the heat entering the inner chamber from outside. The insulating foams normally used are however not able to completely suppress the entry of heat, so that as a rule the lateral walls of the refrigeration device are somewhat cooler than its surroundings and the rear wall. The rear wall of the refrigeration device is as a rule mostly warmer than the lateral walls and the surroundings, since the evaporator is arranged on the rear wall which emits heat to the surroundings. Likewise the front side of the refrigeration device is warmer than the lateral walls, since here there is a good circulation of ambient air and the front side can thus warm up.

BRIEF SUMMARY OF THE INVENTION

The object of the present invention is to specify a refrigeration device, especially a refrigerator or freezer, which exhibits improved thermal insulation and thus makes an improved utilization of energy possible.

In accordance with the invention this object is achieved by the refrigeration device as specified in the independent claim. Further advantageous embodiments and developments, which can be applied individually in each case or can be combined in any given way, are the subject matter of the dependent claims.

The inventive refrigeration device, especially a refrigerator or freezer, comprises a housing which features a top, a base, lateral walls and a rear wall as outer walls and a door. The refrigeration device also comprises an inner chamber located in the housing which is enclosed by inner walls, and a front frame for thermal decoupling of the inner walls from the outer walls, with the lateral walls being thermally insulated from the other walls by a further insulating strip.

The front frame is usually made of plastic and serves to interrupt the heat conduction path along the inner walls through to the outer walls. This is especially important if the inner walls or the outer walls are made of a material with good thermal conductivity, such as metal for example.

The insulating strip serves to reduce the heat conduction along or within the walls of the housing. With the aid of the insulating strip the lateral walls are especially thermally insulated from the top, from the base, from the rear wall and/or from the inner walls. The lateral walls are thermally decoupled from the other outer walls as well as from the inner walls. The insulating strip represents a further heat conduction resistance, which renders a temperature equalization at the housing more difficult and thus an entry of heat into the inner chamber of the housing is reduced. With the aid of the insulating strip a heat transfer from warmer points, such as from the rear wall or from the warmer base or top walls for example is especially reduced. An entry of heat from the front frame into the lateral walls can be also be reduced by the insulating strip. With the aid of the insulating strip the lateral walls are better thermally decoupled, which is especially advantageous if the refrigeration device is incorporated as a built-in device into a fitted furniture unit in which a space (e.g. a thin gap) between the lateral walls and the furniture unit can be used as an additional insulation layer. This space or the furniture unit can thus be used as further insulation.

This has not previously been possible, since the good thermally conducting contact between the lateral walls and the other walls meant that heat from locations lying further away was conducted through to the lateral walls, with the lateral walls not being able to be cooled down as much.

The insulating strip is especially made from material with low thermal conductivity, such as plastic for example.

The insulation strips are especially used to worsen the heat conductivity along the outer surface of the housing and to render temperature equalization between different points on the outer surfaces of the housing more difficult.

Advantageously the insulating strip features a first mounting element, especially a groove, for accepting the lateral walls, the top or the base. With the aid of the first mounting element a mechanically firm connection between the insulating strip and the respective wall is established.

In an advantageously embodiment the insulating strip has a second mounting element, especially a groove, for accepting the front frame. The second mounting element is especially advantageous if the insulating strip is arranged between the lateral wall and the front frame. A mechanically firm connection between the front frame and the insulating strip is established with the aid of the second mounting element, which mechanically stabilizes the front frame.

In a further advantageous embodiment the insulating strip has a third mounting element, especially a clip element, for accepting a reinforcement frame. The insulating strip is additionally mechanically strengthened by the reinforcement frame, which is especially advantageous, if the insulating strip is connected to the front frame. In this case the reinforcement frame can contribute to stabilizing a door-side area of the housing, which is especially advantageous, if large or heavy doors are to be attached to the refrigeration device.

The reinforcement frame is especially intended for strengthening the housing and the door is hinged onto the reinforcement frame. With the aid of the reinforcement frame large forces introduced via a heavy or a heavily loaded door can be transferred evenly to the housing. The reinforcement frame is especially made of metal, preferably of steel. Since the reinforcement frame is connected to the warm hinges it generally has a higher temperature than the lateral walls. With the aid of the insulating strip the reinforcement frame can be thermally decoupled from the cooler lateral walls.

With the aid of the insulating strip together with the reinforcement frame the housing can be designed to be mechanically (torsionally) more rigid and thermally better insulated. This especially makes it possible to design the front frame more simply, with said frame having to be a comparatively complicated design in previously known refrigeration devices, since it also performed a mechanical stabilizing function at least to some extent.

For an improved thermal decoupling of the insulating strip support and/or spacer ribs are especially provided to reduce the heat conductance between the lateral walls and the other walls or the reinforcement frame. As well as the use of a material with especially bad thermal conductivity for the insulating strip, the support or spacer ribs represent an advantageous constructive measure to further reduce the heat transfer. In particular a heat transfer path between the lateral walls and the other walls or lateral walls and the reinforcement frame can be extended by the use of the support or spacer ribs. By extending the heat transfer path the entry of energy from outside into the inside of the refrigeration device is reduced. Advantageously the heat transfer path is extended by at least 50%, especially by at least 100%, preferably by at least 200%, with the heat transfer output being reduced by a corresponding factor.

In an advantageous embodiment of the invention the insulating strip features sealing fins for sealing the housing while it is being filled with foam in order to prevent insulating foam 48 escaping to the exterior.

The insulating strip can thus also be used to seal the housing during foam filling such that no liquid insulating foam gets out. The assembly of the refrigeration device can thus be simplified. Previously it was often necessary to connect the sides and the other walls by means of sealing spring-groove connections which resulted in considerable installation effort. By using sealing fins for example the housing compartment can be foam filled, by the front side the housing being laid down ("bell position") and the rear wall being laid on the insulation strips provided on the lateral walls, in which case, simply by laying the rear wall on the fins of the insulating strip a sufficient sealing is obtained, so that a foam filling of the housing can be implemented comparatively simply. The use of sealing fins can thus make the process of manufacturing the refrigeration device, especially that of filling the housing with foam, very much more simple.

Advantageously the insulating strip is arranged between the lateral walls and the front frame and the insulating strip connects the lateral walls to the front frame.

In a further embodiment the insulating strip is arranged between the lateral walls and the rear wall. In this case a thermal decoupling of the lateral walls from the rear wall is obtained.

In a specific embodiment the insulating strip has a contact surface for the rear wall, so that the insulating strip is partly surrounded by the rear wall. With the aid of the contact surface, especially using the sealing fins on the contact surface, a seal is obtained which prevents the escape of foam during the process of filling the housing with foam. This considerably simplifies the process of filling the housing with foam.

Advantageously the insulating strip is arranged between the lateral walls and the top or between the lateral walls and the base. A thermal decoupling of the lateral walls from the top or from the base is obtained in this way, with the temperature of the lateral walls being able to be reduced during operation of the refrigeration device and thus the efficiency of the refrigeration device being able to be increased.

BRIEF DESCRIPTION OF THE DRAWINGS

Further details and specific embodiments, which can each be used individually or combined in any way with each other, are explained in greater detail with reference to the following drawing, and are not intended to restrict the invention but are merely designed as typical illustrations.

The figures show the following schematic diagrams:

FIG. 5 an embodiment of a front frame for an inventive refrigeration device, FIG. 6 a detailed view of the refrigeration device as depicted in FIG. 1, FIG. 7 a detailed view of a reinforcement frame as depicted in FIG. 2 or 3, FIG. 8 a further detailed view of a reinforcement frame, FIG. 9-11 different perspective views of a lower hinge mounting, FIG. 12 a perspective view of an upper or central hinge mounting, FIG. 13 the hinge mounting from FIG. 12 in a sectional view, FIG. 14 a housing of an inventive refrigerator in a perspective sectional view, FIG. 15 a further inventive refrigeration device, FIG. 16 a perspective sectional view of a lateral wall with a reinforcement frame and an insulating strip, FIG. 17 a perspective sectional view of a rear wall with an insulating strip, FIG. 18 a perspective sectional view which shows the upper left corner of an inventive refrigerator.

DETAILED DESCRIPTION OF THE PRESENT INVENTION

Figure 1:
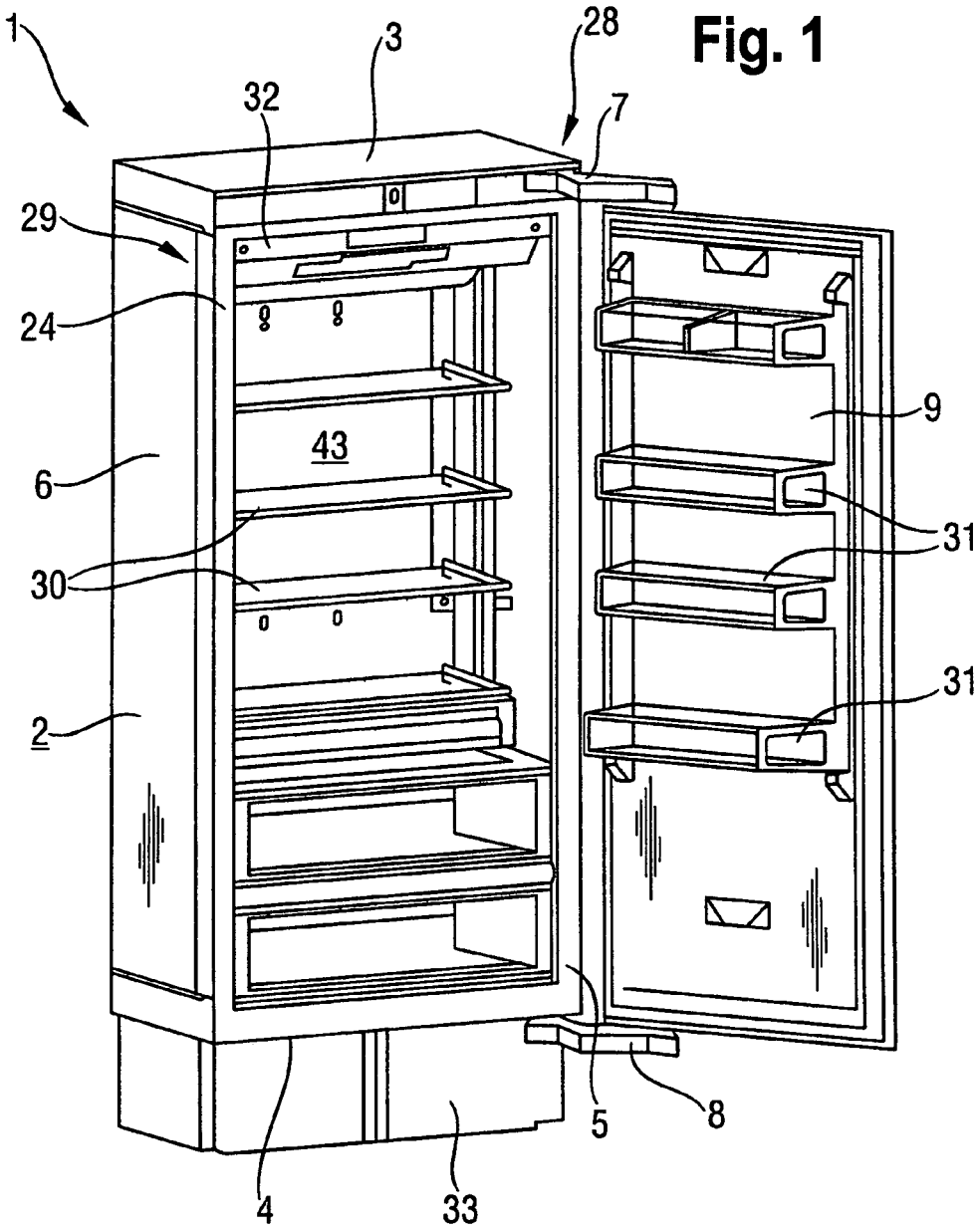
FIG. 1 an inventive refrigerator in a perspective angled view

FIG. 1 shows an inventive refrigeration device 1 with a housing 2, which comprises a top 3, a base 4, a first lateral wall 5 and a second lateral wall 6. The refrigeration device 1 features an interior 43 which can be closed or opened by a door 9. The door 9 has door compartments 31 and is attached by a first hinge 7 and a second hinge 8 to the housing 6. In the interior 43 shelves for holding goods (not shown) and an evaporator 32 for creating cold air are provided. The door 9 is attached on a first, right-hand door side 28. In a door-side area of the housing 2 a front frame 24 made of plastic is provided, which suppresses the conduction of heat from the comparatively warmer lateral walls 6, 7 of the top 3 or of the base 4 into the interior 43. The door 9 can be switched by converting the hinges 7, 8 to a second, right-hand door side 29.

Figure 2:
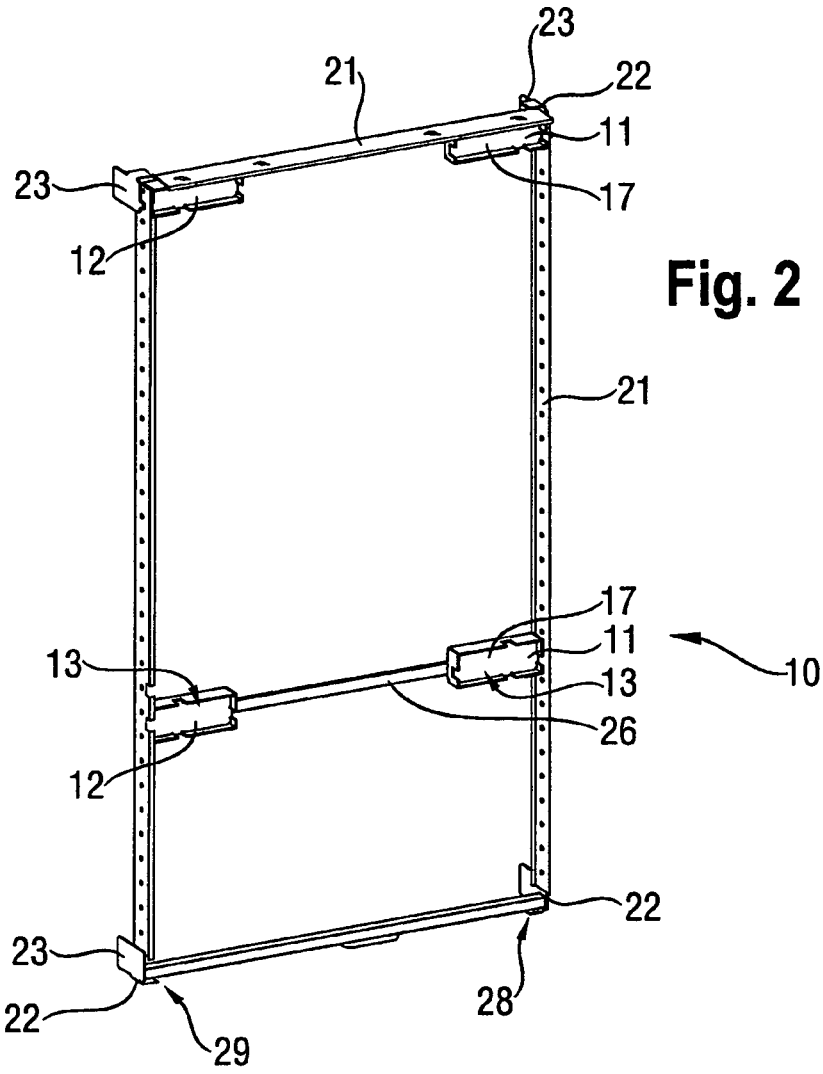
FIG. 2 and FIG. 3 different embodiments of a reinforcement frame used for an inventive refrigeration device, FIG. 4 a detailed view of a reinforcement frame as depicted in FIG. 2 or 3

FIG. 2 shows a perspective view of a reinforcement frame 10, which is used for strengthening the housing 2 in a door-side area. The reinforcement frame 10 is assembled from profile bars 21 and corner connectors 22 which are connected to each other using a jointing method. Attached to the reinforcement frame are first mountings 11 arranged on the first door side 28 and second mountings 12 arranged on the second door side 29. The mountings 11, 12 feature a mounting surface 17 to which the hinges 7, 8 can be attached. The mountings 11, 12 are embodied as pockets 13 and to at least partly firmly surround the hinges 7, 8, which prevents the hinges from shaking loose or from twisting. Force distribution elements 23 are provided at the corner connectors 22 which transfer the forces introduced into the reinforcement frame 10 to a housing 2. The reinforcement frame 10 is divided up by a transverse bar 26 so that an upper and the lower frame are formed which in each case correspond to the compartments of the refrigeration device 1.

Figure 3:
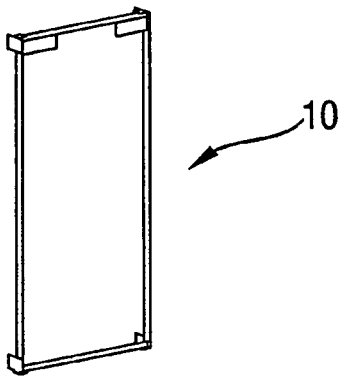

FIG. 3 shows a reinforcement frame 10 without such a transverse bar 26. With the aid of the reinforcement frame and 10 the housing 2 is stabilized in a door-side area and is designed with a greater torsional rigidity. The forces of wide and heavy doors 9 can especially be accommodated by said frame and transferred evenly to the housing 2.

FIG. 4 shows a detailed perspective view of a mounting 11 of the reinforcement frame 10, with the mounting 11 featuring the mounting surface 17 for the hinges 7, 8. The mounting 11 is designed as a box 16 with first box side walls 19 and second box side walls 20, with a pocket 13 being formed which accepts a hinge box 25 of the front frame 24 and the hinge 7, 8. The box 16 is connected with two of its side walls 19, 20 to the reinforcement frame 10, whereby an especially robust connection is obtained. The profile bars 21 are firmly connected to one another by the box 16 and the corner connectors 22. The corner connector 22 has a force distribution element 23 with which the reinforcement frame 10 is attached to the housing 2.

FIG. 5 shows the front frame 24 in a perspective angled view for the reinforcement frame as depicted in FIG. 3 with hinge boxes 25.

Figure 6:
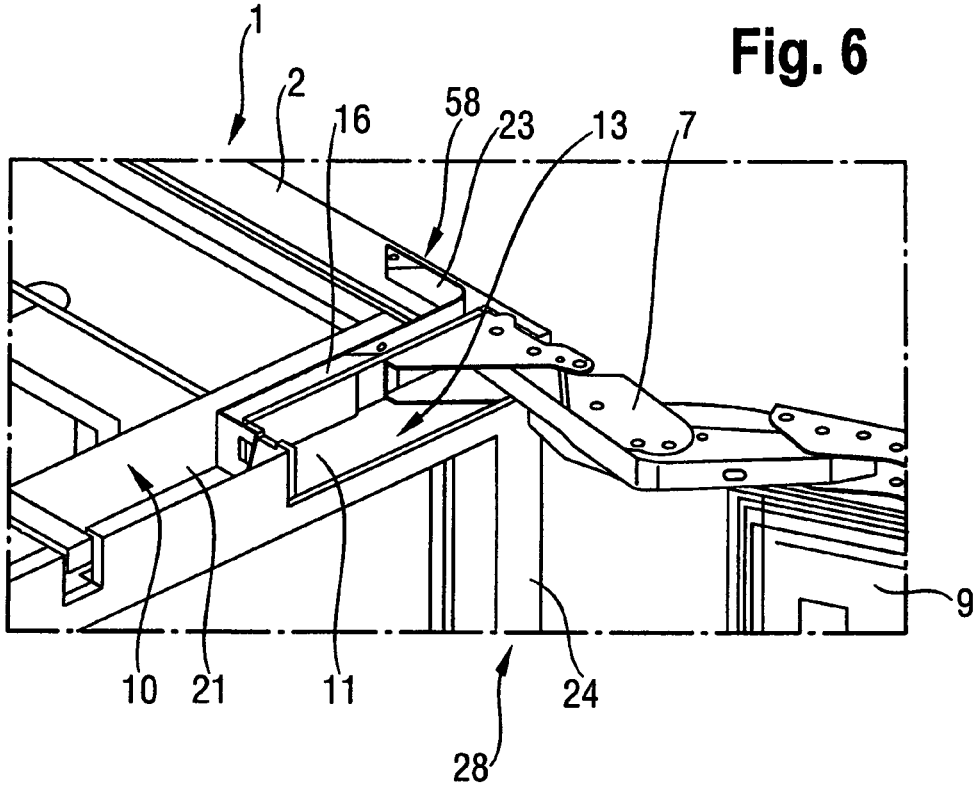

FIG. 6 shows a perspective angled view of an upper right hand corner of an inventive kitchen device 1, with the hinge 7 being recessed into the housing and integrated into the pocket 13.

The pocket 13 is provided on the first mounting 11. The mounting 11 is especially strengthened by the box 16. The box 16 is also used to support the corner connectors 22 which connect the profile bars 21 of the reinforcement frame 10 to each other, in that the box is mechanically firmly connected on two of its sides 19, 20 to the profile bars 21. The reinforcement frame 10 is attached via a force distribution element 23 to the housing 2, to enable the force to be introduced over the largest possible area evenly into the housing 2 onto a surface of approximately 70 $cm^2$.

Figure 7:
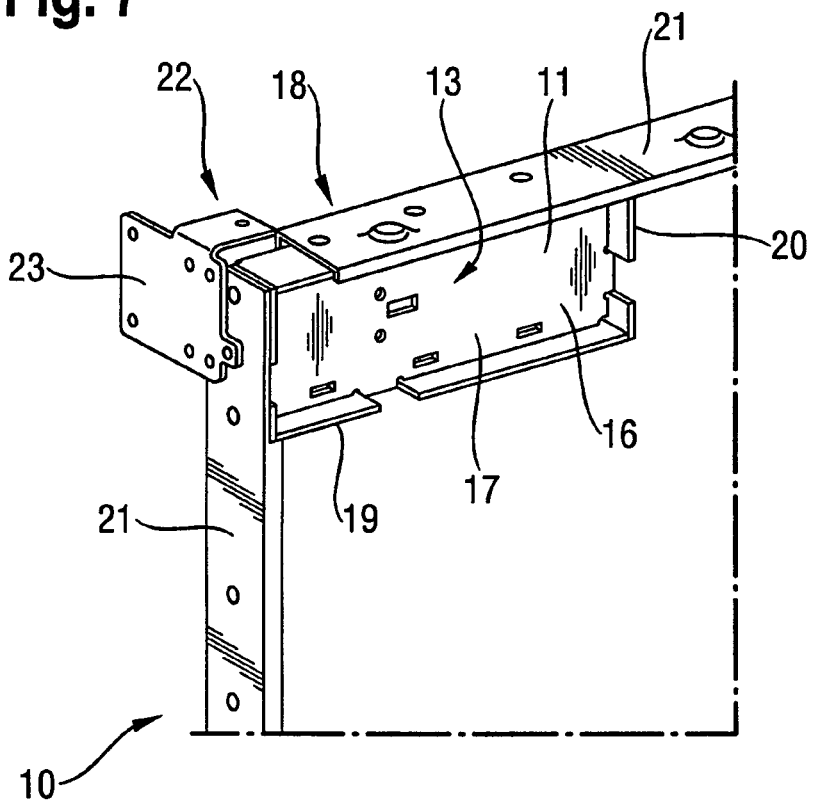

FIG. 7 shows a detailed perspective view of the reinforcement frame 10. The profile bars 21 are torsionally rigidly connected to each other by the corner connectors 22 and the box 16. The mounting 11 features the mounting surface 17 which is framed or enclosed by the box side walls 19, 20 so that a pocket 13 is formed. Attached to the corner connectors 22 is the force distribution element 23 with which the forces acting on the reinforcement frame are transferred as evenly as possible to the housing 2.

Figure 8:
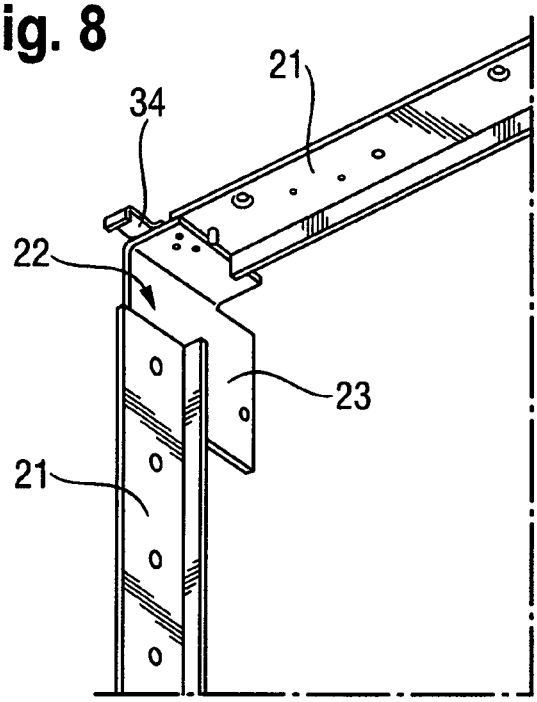

FIG. 8 shows an angled perspective view of a further embodiment of the corner connector 22 for connecting the profile bars 21 of the reinforcement frame 10, with a positioning element 34 for positioning at the front frame 24 relative to the reinforcement frame 10 being provided on the corner connector 22. With the aid of the positioning element 34 the reinforcement frame is arranged during installation of the refrigeration device 1 precisely in relation to the front frame 24.

Figure 9:
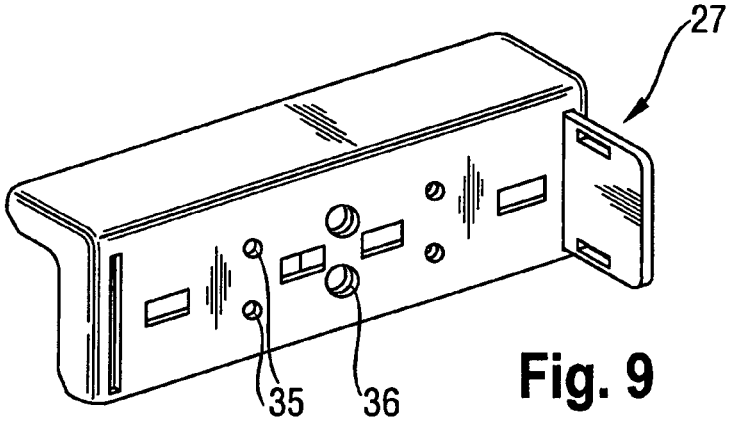
Figure 10:
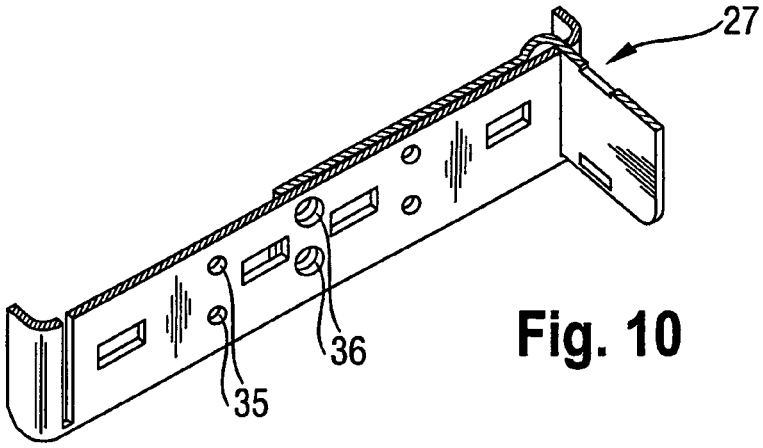
Figure 11:
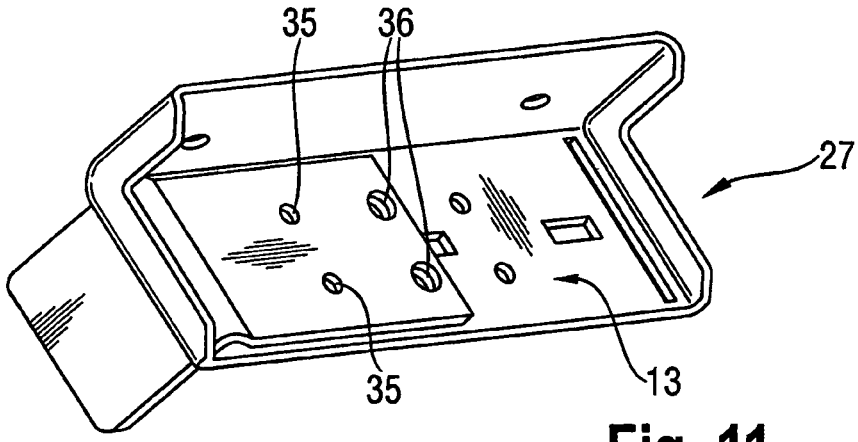

FIGS. 9-11 show different perspective views of a lower hinge mounting 27, which is attached in the area of the plinth 23 from below to the housing 2. FIGS. 9-11 here show the same lower hinge mounting 7 from different directions, with FIG. 10 being a sectional view. The lower hinge mounting 27 like the first 11 and second 12 mounting, features a pocket 13 which accepts the hinge 7, 8. The hinge 7, 8 is aligned with the aid of pins 35 and screwed in with the aid of threaded holes 26. The lower hinge mounting 27 can be a converted from a first door side 28 to a second door side 29.

Figure 12:
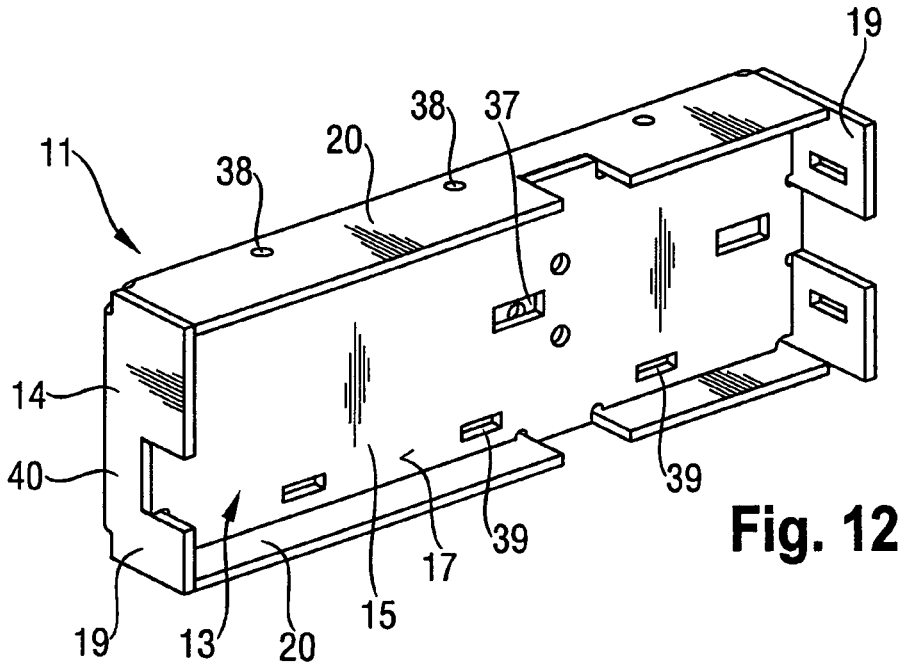
Figure 13:
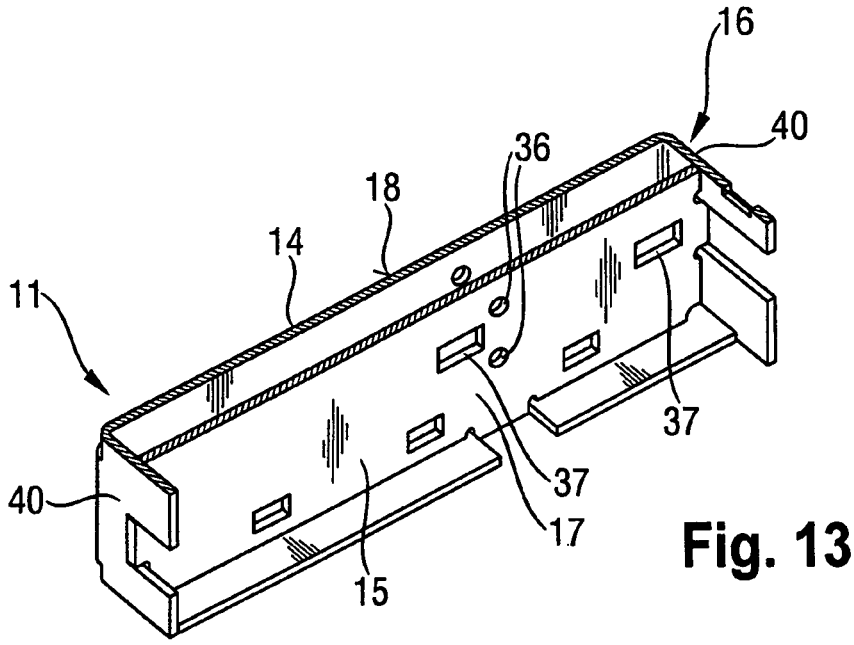

FIG. 12 shows a perspective angled view of a mounting 11, 12 for a hinge 7, 8 with a pocket, which is shown in FIG. 13 as a sectional view. The mounting 11 comprises a base part 40 and a screw plate 15 which are joined together to form the box 16. The first box side wall 19 and the second box side wall 20 form the pocket 13 with their edges 40 together with the mounting surface 17. The box 16 ensures an especially high torsional rigidity of the mounting 11 and the mounting 11 can be connected with the first box side wall 19 and the second box side wall 20 to the reinforcement frame 10. The mounting surface 17 of the mounting 11 has locating holes 37 for the hinge 7, 8, which simplifies installation of the hinge 7, 8. In addition the mounting surface 17 features second attachment elements 39 for connecting the mounting 11 to the hinge box 25, by which a positioning of the front frame 24 on the reinforcement frame 10 is simplified. With the aid of first attachment elements the box 16 is attached to the reinforcement frame 10 and, especially to the profile bars 21 or the corner connectors 22. The box 16 has a box rear side 18.

Figure 14:
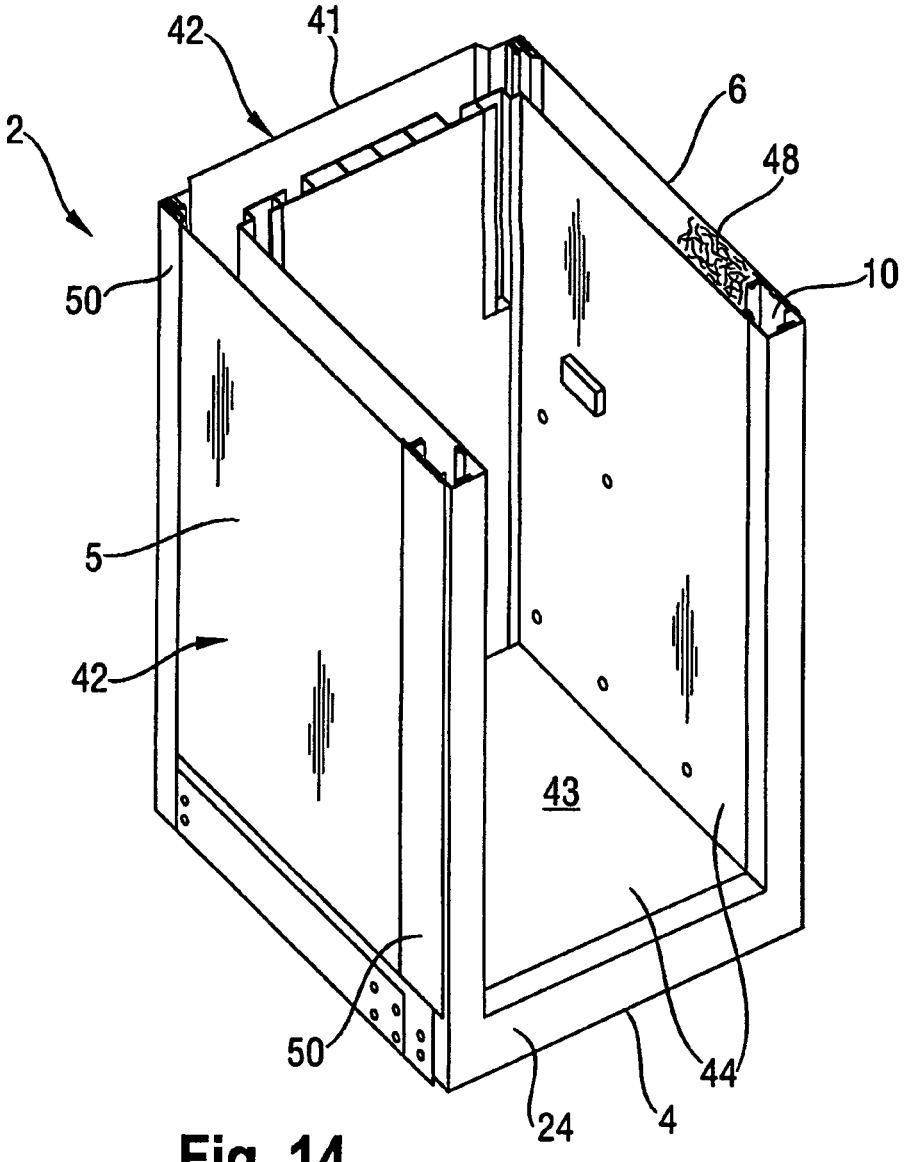

FIG. 14 shows a perspective sectional view of a further inventive refrigeration device 1 and shows that the front frame and 24 is attached by an insulating strip 50 to the first lateral wall 5 or the second lateral wall 6. The interior 43 of the refrigerator 1 features internal walls 44. The refrigeration device features a rear wall 41. The rear wall 41, the lateral walls 5, 6, the base 4 and the top 3 form outer walls 42 of the refrigeration unit 1. Between the inner walls 44 and the outer walls 42 an insulating foam 48 is provided for thermal insulation of the interior 43. The reinforcement frame 10 is used for a stabilization or stiffening of the housing 2 in a door-side area. The reinforcement frame 10 is however not connected directly to the lateral walls 5, 6 but is thermally insulated from the walls by an insulating strip 50. This makes it harder for heat to be conducted from the comparatively warm reinforcement frame 10 to the generally comparatively warm lateral walls 5, 6, which improves the energy utilization of the refrigeration device 1. The insulating strip 50 is made of plastic. The rear wall 41 is likewise thermally insulated from the lateral walls 5, 6 by insulating strips 50. The rear wall 41 is as a rule very much warmer than the lateral walls 5, 6, since the evaporator of the refrigeration device 1 is located as a rule on or at the rear wall 41 and heat is output at this point. The lateral walls 5, 6 cool down comparatively on the other hand as a result of the incomplete thermal decoupling by the insulating foam 48. The insulating strip 50 between the rear wall 41 and the lateral walls 5, 6 reduces a heat transfer to the lateral walls 5, 6 so that in front of the lateral walls 5, 6, especially when the refrigeration device 1 is built into a fitted unit (not shown) an insulating layer of air can build up which additionally insulates the refrigeration device 1.

Figure 15:
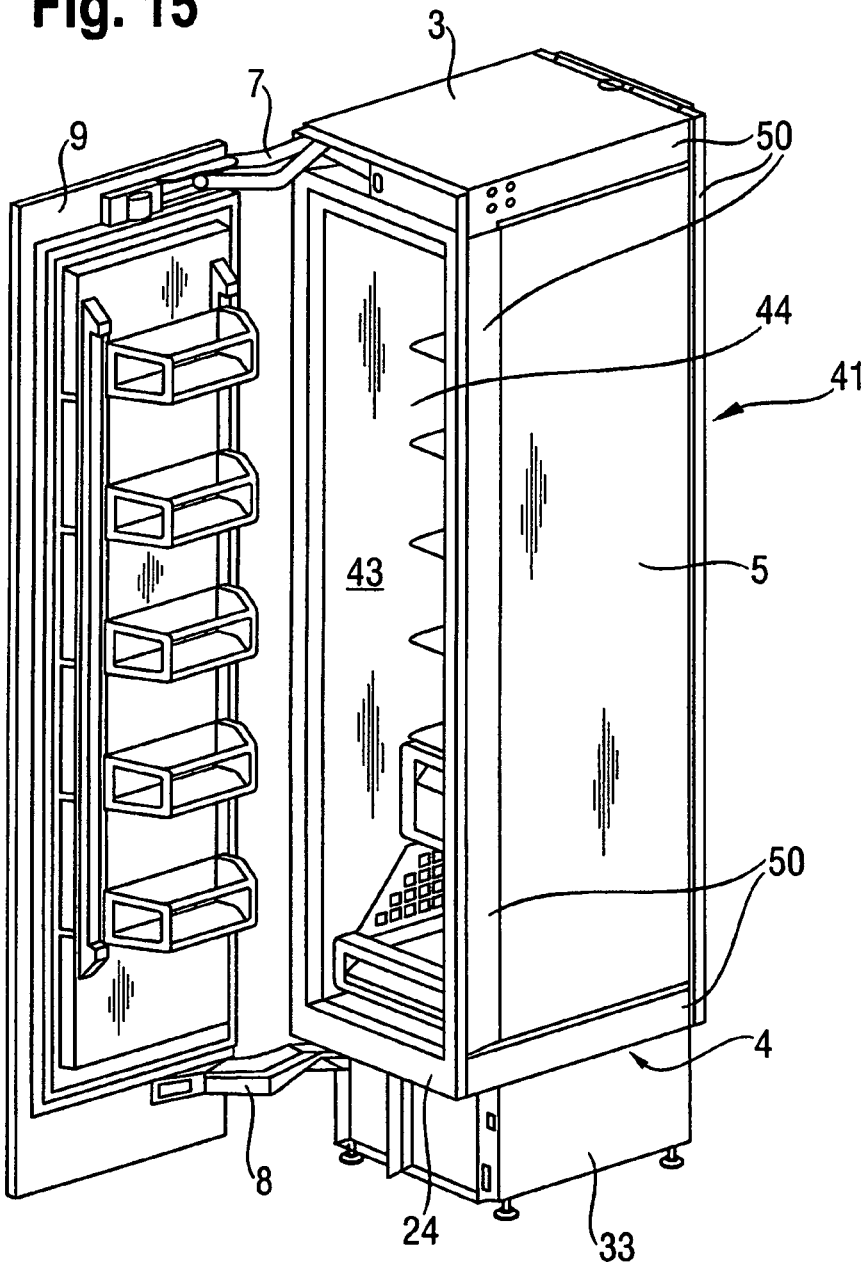

FIG. 15 shows a perspective view of an inventive refrigerator 1, where the lateral walls 5, 6 are thermally insulated from the top 3, the base 4, the rear wall 41 as well as from the inner walls 44 by the insulating strip 50. Heat conducted from the base 4, the top 41 as well as the inner walls 44 through to the lateral walls 5, 6 is significantly reduced by this, with the efficiency of the refrigerator 1 being improved. The insulating strips 50 on the front frame 24 and the lateral walls 5, 6 serve to thermally insulate the reinforcement frame 10 from the lateral walls 5, 6. The reinforcement frame 10 contributes to improving the mechanical stability of the housing 2, especially with a wide and heavy doors 9, by improving the transfer of forces from the door 9 to the housing 2. The second hinge 8 is applied from below in the area of the plinth 33 to the base 4 of the housing 2 which does not to lose any space in the interior 43.

Figure 16:
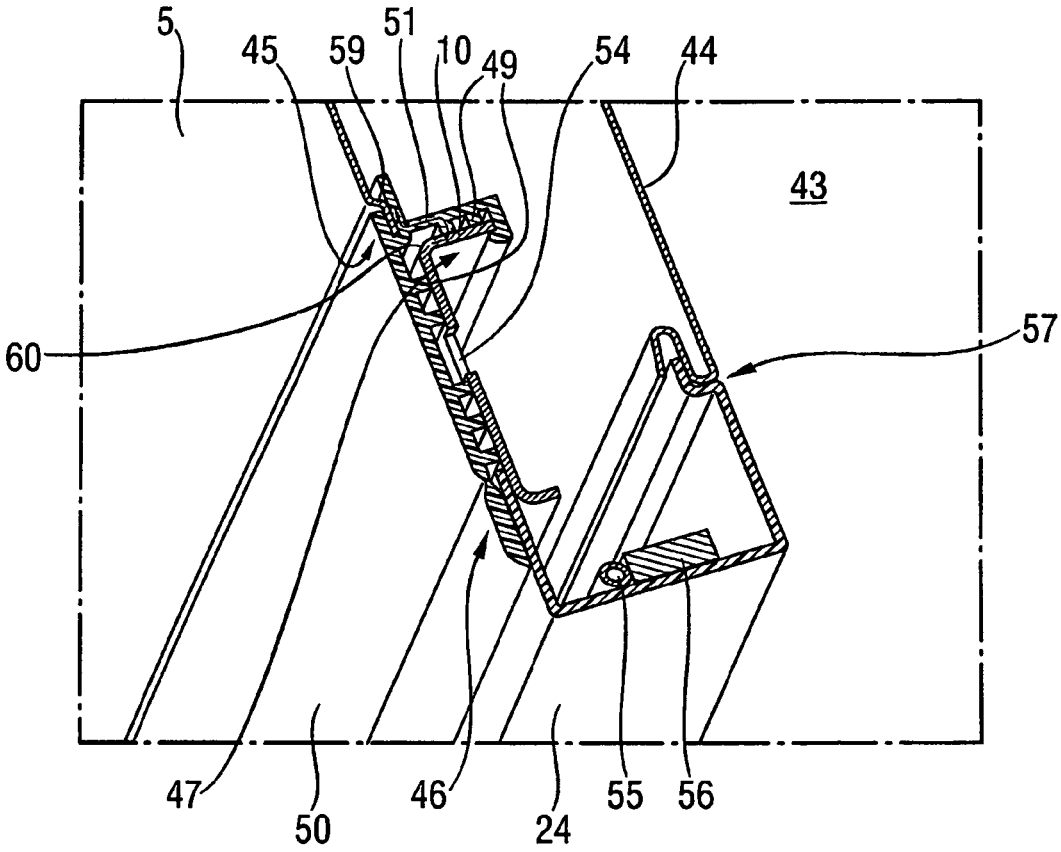

FIG. 16 shows a detailed view of the lateral wall 5 with the reinforcement frame 10 and the insulating strip 50, the front frame 24 and the inner wall 44. The inner wall 44 is connected to the front frame 24 with the aid of a connection element 47 embodied a as groove. The front frame features a heating device 55 and a magnetic strip 56 for closing the door 9. The front frame 24 is made from plastic and is attached with the aid of a second mounting element 46 to the insulating strip 50. The insulating strip 50 is attached with the aid of third mounting element 47 to the reinforcement frame 10, especially clipped on. The insulating strip 50 is attached with the aid of first mounting element 45 to the lateral wall 5. The insulating strip 50 is used in this case to thermally insulate the reinforcement frame 10 from the colder lateral wall 5. For an improved thermal decoupling, support or spacer ribs 49 are provided on the insulating strip which significantly extend a heat-conducting path 51 between the lateral wall 5 and the reinforcement frame 10. Here the heat conducting path 51 between one edge 59 of the lateral wall 5 and a corner 60 of the reinforcement frame 10 is almost doubled, with the heat conduction being correspondingly halved.

Figure 17:
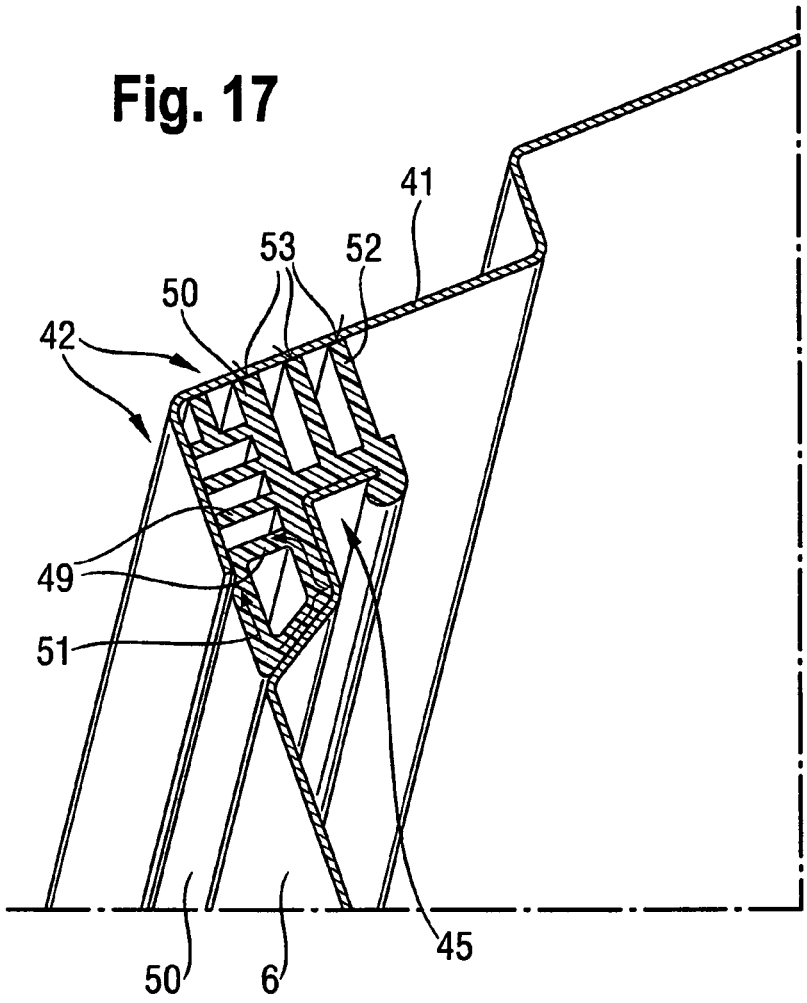

FIG. 17 shows a perspective sectional view of the insulating strip 50 between the rear wall 41 and the lateral wall 6. The insulating strip 50 between the rear wall 41 and the lateral wall 5, 6 is used to better thermally insulate the warmer rear wall 41 from the comparatively colder lateral walls 6, so that an air pillow formed in front of the lateral wall 5, 6 can be used as additional insulation for the housing 2. The insulating strip has support and/or a spacer ribs to further reduce the thermal heat transfer within the insulating strip 50. The support and/or spacer ribs 49 extend the heat transfer path 51 within the insulating strip 50 and thus reduce the heat transfer within the insulating strip 50. The insulating strip 50 also features sealing fins 52 through which the housing 2 is sealed from an escape of insulating foam 48 when the housing 2 is being filled with foam. With the aid of the sealing fins 52 it is possible to simply lay the rear wall onto a mounting surface 53 of the insulating strip and subsequently fill the housing 2 with foam, without the insulating foam 48 penetrating to the exterior. This it is especially advantageous against the background of an installation of the refrigeration device 1 since in this way the rear wall, which is generally heavy, no longer has to be introduced via grooves but can merely be laid on to the housing 2 and foam-filled.

Figure 18:
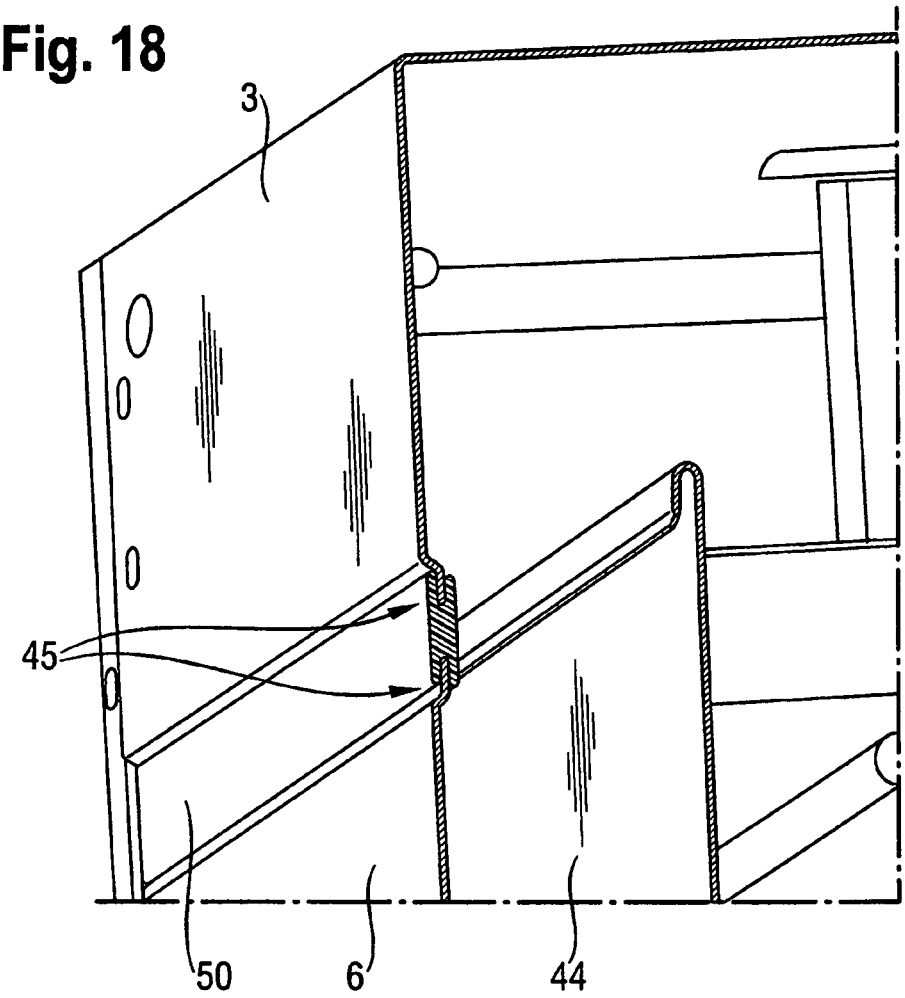

FIG. 18 shows the insulating strip 50 between the lateral wall 6 and the top 3. The insulating strip is connected with the aid of first mounting elements 45 to the top 3 or to the lateral walls 5, 6. Here too the insulating strip 50 is used to thermally insulate the colder lateral wall 5, 6 from the warmer top 3.

Further different aspects which are related to the invention are described below. The individual aspects can each be employed individually, i.e. independently of each other, or combined in a suitable manner in any way with each other and with the aforementioned aspects:

An especially advantageously refrigeration device 1, especially a refrigerator and/or freezer, comprises a housing 2 with a top 3, a base 4, lateral walls 5, 6 and at least one door 9 attached by hinges 7, 8, with a reinforcement frame 10 being provided on the housing 2, to which the door 9 is attached by the hinges 7, 8 with the reinforcement frame 10 especially being attached to the top 3 and to the base 4 and/or to the lateral walls 6. Advantageously there is provision for the reinforcement frame (4) to run around the housing 2 along the top 6, the base 4, and the lateral walls 5, 6. The reinforcement frame 10 especially features at least one, especially at least two, especially at least four mountings 11, 12 for the hinges 7, 8, with the mounting 11, 12 especially forming a pocket 13 which accommodates especially up to at least 50%, preferably up to 80%, especially preferably up to at least 90% of the volume of the hinge 7, 8. It is of advantage for the mounting 11, 12 to comprise a base part 14 and a screw plate 15, with the base part 14 and the screw plate 15 especially being connected by a jointing method to form a box 16, with the box 16 featuring a mounting surface 17 for the hinge 7, 8, a rear side of the box 18 opposite the mounting surface 17 and box side walls 19, 20, with the box 16 especially being attached by at least one, preferably by two of its box side walls 19, 20 to the reinforcement frame 10. In a special embodiment there is provision for the reinforcement frame 10 to feature a first mounting 11 for hinging the door 9 on a first lateral wall 5 and a second mounting 12 for hinging the door on a second lateral wall 6. In a further embodiment there is provision for the reinforcement frame 10 to be made up of profile bars 21, especially U- or L-profile, and corner connectors 22, with the profile bars through being connected to each other by corner connectors 22, with especially the corner connectors 22 featuring force distribution elements 23 through which a force exerted on the reinforcement frame 10 is transmitted to the housing 2, with a force distribution element 23 especially having a contact surface 58 to the housing 2, which amounts to at least 15 $cm^2$, especially at least 25 $cm^2$, preferably at least 50 $cm^2$. Advantageously the reinforcement frame 10 is connected to a front frame 24 of the refrigeration device 1, with the reinforcement frame 10 especially having a positioning element 34 for positioning the front frame 24. It is of advantage for the front frame 24 to feature a hinge box 25. In a further embodiment of the invention there is provision for the reinforcement frame 10 to feature a transverse bar 26. A lower hinge mounting 27 can also be provided which is able to be attached from below to the refrigeration device 1 can be switched from one door side 28 to another door side 29 the invention relates to a refrigeration device 1, especially a refrigerator or freezer, comprising a housing 2 which features a top 3, a base 4, lateral walls 5, 6 and a rear wall 41 as outer walls 42 and a door 9, an inner chamber 43 located in the housing 2 which is surrounded by inner walls 44, and a front frame 24 for thermally decoupling the inner walls 44 from the outer walls, with the lateral walls 5, 6 being thermally insulated from the other walls 3, 4, 41, 44 by a further strip of insulation 50. The invention is characterized in that the entry of heat from outside into the inner chamber via the lateral walls 5, 6 is considerably reduced by the thermal decoupling of the lateral walls, with the efficiency of the refrigeration device 1 in being significantly increased.

List of reference symbols

| | |
|---|---|
| 1 | Refrigeration device |
| 2 | Housing |
| 3 | Top |
| 4 | Base |
| 5 | First lateral wall |
| 6 | Second lateral wall |
| 7 | First hinge |
| 8 | Second hinge |
| 9 | Door |
| 10 | Reinforcement frame |
| 11 | First mounting |
| 12 | Second mounting |
| 13 | Pocket |
| 14 | Base part |
| 15 | Screw plate |
| 16 | Box |
| 17 | Mounting surface |
| 18 | Rear side of box |
| 19 | First box side wall |
| 20 | Second box side walls |
| 21 | Profile bars |
| 22 | Corner connector |
| 23 | Force distribution element |
| 24 | Front frame |
| 25 | Hinge box |
| 26 | Transverse bar |

-continued

| List of reference symbols | |
|---|---|
| 27 | Lower hinge mounting |
| 28 | First door side |
| 29 | Second door side |
| 30 | shelf |
| 31 | Door compartment |
| 32 | Evaporator |
| 33 | Plinth |
| 34 | Positioning element |
| 35 | Guide pin |
| 36 | Threaded hole |
| 37 | Locating holes |
| 38 | First attachment element |
| 39 | Second attachment element |
| 40 | Edge |
| 41 | Rear wall |
| 42 | Outer walls |
| 43 | Interior |
| 44 | Inner walls |
| 45 | First mounting element |
| 46 | Second mounting element |
| 47 | third mounting element |
| 48 | Insulating foam |
| 49 | Support or spacer ribs |
| 50 | Insulating strip |
| 51 | heat transfer path |
| 52 | Sealing fins |
| 53 | Mounting surface |
| 54 | Through openings |
| 55 | Heating device |
| 56 | Magnetic strip |
| 57 | Connecting element |
| 58 | Contact surface |
| 59 | Edge |
| 60 | Corner |

The invention claimed is:

1. A refrigeration device, including at least one of a refrigerator and a freezer, the refrigeration device comprising:

a housing including a top, a base, a plurality of lateral walls and a rear wall forming outer walls;

an inner chamber located in the housing which is formed by inner walls, with the inner walls being fitted in a nested relationship with the outer walls and defining an access opening to the inner chamber;

a door for selectively covering the access opening;

a front frame disposed intermediate the inner walls and the outer walls for thermally decoupling the inner walls from the other walls, the front frame being exposed as an external surface of the housing; and at least one insulating member disposed in an operative relationship with at least one of said lateral walls for thermally insulating the at least one lateral wall from the other walls, wherein the front frame has a U shape including a first leg of the U shape and a second leg of the U shape separated by a base portion, and wherein a first end portion of the first leg is connected to the inner walls by at least one connection element and a second end portion of the second leg is connected to the at least one insulating member.

2. The refrigeration device according to claim 1 wherein the at least one insulating member includes a mounting element, the mounting element being formed as one of a groove and a structure not formed as a groove, for accepting at least one of the lateral walls, the top and the base.

3. The refrigeration device according to claim 1 wherein the at least one insulating member includes a second mounting element, the mounting element being formed as one of a groove and a structure not forming a groove, for accepting the front frame.

4. The refrigeration device according to claim 1 wherein the at least one insulating member includes a mounting element, the mounting element being formed as one of a clip element and not a clip element, for accepting a reinforcement frame.

5. The refrigeration device according to claim 4 wherein the reinforcement frame includes means for strengthening the housing and the door is hingedly mounted onto the reinforcement frame.

6. The refrigeration device according to claim 5 wherein the reinforcement frame includes profile bars which include a plurality of openings extending there through for contacting the insulating member with insulating foam.

7. The refrigeration device according to claim 1 wherein the at least one insulating member further comprises a plurality of ribs including at least one of support ribs and spacer ribs for reducing the heat conductivity between the lateral walls and at least one of the other walls and at least one reinforcement frame is disposed on the insulating member.

8. The refrigeration device according to claim 7 wherein the length of at least one of the support ribs is at least 50% of the distance between the lateral wall and the adjacent at least one of the other walls, such that a heat transfer path between the lateral wall and at least one of the adjacent other wall and the reinforcement frame is extended by at least 50% by the at least one of the support ribs and the spacer ribs.

9. The refrigeration device according to claim 7 wherein the length of at least one of the support ribs is at least the distance between the lateral wall and the adjacent at least one of the other walls, such that a heat transfer path between the lateral wall and at least one of the adjacent other wall and the reinforcement frame is extended by at least 100% by the at least one of the support ribs and the spacer ribs.

10. The refrigeration device according to claim 7 wherein the length of at least one of the support ribs is at least twice the distance between the lateral wall and the adjacent at least one of the other walls, such that a heat transfer path between the lateral wall and at least one of the adjacent other wall and the reinforcement frame is extended by at least 200% by the at least one of the support ribs and the spacer ribs.

11. The refrigeration device according to claim 1 wherein the at least one insulating member is disposed between the at least one lateral wall and the front frame and connects the lateral wall to the front frame.

12. A refrigeration device, including at least one of a refrigerator and a freezer, the refrigeration device comprising:

a housing including a top, a base, a plurality of lateral walls and a rear wall forming outer walls;

an inner chamber located in the housing which is formed by inner walls, with the inner walls being fitted in a nested relationship with the outer walls and defining an access opening to the inner chamber;

a door for selectively covering the access opening;

a front frame disposed intermediate the inner walls and the outer walls for thermally decoupling the inner walls from the other walls;

at least one insulating member disposed in an operative relationship with said lateral walls for thermally insulating the lateral walls from the other walls; and a reinforcement frame to provide structural support to the housing, the reinforcement frame being connected to at least one of the lateral walls, wherein the at least one insulating member includes a plurality of spaced-apart ribs protruding from a surface thereof to abut against a common surface of 1 ) the reinforcement frame or 2) at least one of the other walls to increase a distance between 1) the lateral walls and 2) the reinforcement frame and/or at least one of the other walls to thereby reduce a heat conductivity between 1) the lateral walls and 2) the reinforcement frame and/or at least one of the other walls.

13. The refrigeration device according to claim 12, wherein the at least one insulating member includes a mounting element, the mounting element being formed as one of a groove and a structure not formed as a groove, for accepting at least one of the lateral walls, the top and the base.

14. The refrigeration device according to claim 12, wherein the at least one insulating member includes a second mounting element, the mounting element being formed as one of a groove and a structure not forming a groove, for accepting the front frame.

15. The refrigeration device according to claim 12, wherein the at least one insulating member includes a mounting element, the mounting element being formed as one of a clip element and not a clip element, for accepting the reinforcement frame.

16. The refrigeration device according to claim 15, wherein the ribs are arranged to abut against the reinforcement frame.

17. The refrigeration device according to claim 12, wherein the at least one insulating member includes sealing fins to seal the housing during a filling procedure to prevent insulating foam from escaping the housing.

18. The refrigeration device according to claim 17, wherein the at least one insulating member includes a contact surface for the rear wall wherein the at least one insulating member is partly surrounded by the rear wall.

19. The refrigeration device according to claim 12, wherein the at least one insulating member is disposed between the lateral walls and the rear wall.

20. The refrigeration device according to claim 15, wherein the ribs are arranged to abut against the rear wall.

* * * * *